United States Patent [19]

Kurherr

[11] Patent Number: 5,032,068

[45] Date of Patent: Jul. 16, 1991

[54] DISPLACEMENT TYPE ROTARY SYSTEM STEAM TURBINE ENGINE

[76] Inventor: Waldemar H. Kurherr, Heerdter Landstr. 201, 4000 Duesseldorf 11, Fed. Rep. of Germany

[21] Appl. No.: 568,617

[22] Filed: Aug. 16, 1990

Related U.S. Application Data

[63] Continuation of Ser. No. 262,342, Oct. 25, 1988, abandoned.

[51] Int. Cl.[5] ..... F01C 1/20; F01C 19/00; F01C 21/00

[52] U.S. Cl. ..... 418/10; 418/71; 418/141; 418/178; 418/196; 418/200

[58] Field of Search ..... 418/9, 10, 71, 73, 112, 418/141, 144, 178, 191, 196, 200, 227

[56] References Cited

U.S. PATENT DOCUMENTS

| | | | |
|---|---|---|---|
| 23,267 | 3/1859 | Roots | 418/191 |
| 274,479 | 3/1883 | Forbes | 418/196 |
| 635,849 | 10/1899 | Fite | 418/191 |
| 689,251 | 12/1901 | Unbehend | 418/196 |
| 899,148 | 9/1908 | Westrich | 418/191 |
| 957,508 | 5/1910 | Hilty | 418/10 |
| 980,075 | 12/1910 | Doke | 418/196 |
| 1,027,091 | 5/1912 | Weddington | 418/71 |
| 1,064,169 | 6/1913 | Prall | 418/73 |
| 2,310,078 | 2/1943 | Herman | 418/178 |
| 2,414,779 | 1/1947 | Tumey et al. | 418/9 |
| 2,956,735 | 10/1960 | Breelle | 418/10 |
| 3,545,895 | 12/1970 | Weatherston et al. | 418/200 |
| 3,873,252 | 3/1975 | Motomura | 418/126 |
| 3,941,527 | 3/1976 | Allington | 418/196 |
| 3,977,817 | 8/1976 | Monteil | 418/141 |

FOREIGN PATENT DOCUMENTS

| | | | |
|---|---|---|---|
| 749569 | 5/1956 | United Kingdom . | |
| 838166 | 6/1960 | United Kingdom . | |
| 843675 | 8/1960 | United Kingdom | 418/196 |
| 848027 | 9/1960 | United Kingdom . | |
| 1174876 | 12/1969 | United Kingdom . | |

*Primary Examiner*—John J. Vrablik
*Attorney, Agent, or Firm*—Cushman, Darby & Cushman

[57] ABSTRACT

The instant invention relates to a displacement-type rotary system steam-turbine engine that among other mainly functions as a displacing-type steam engine. Through the partial utilization of the kinetic energy generated by the impinging steam molecules upon the rotor blades said invention functions additionally similar to a radial flow turbine.

26 Claims, 4 Drawing Sheets

DISPLACEMENT TYPE ROTARY SYSTEM STEAM TURBINE ENGINE

This is a continuation of application No. 07/262,342, filed Oct. 25, 1988 which was abandoned upon the filing hereof.

BACKGROUND OF THE INVENTION

In the past many different types of rotary steam engines have been built some by such eminent inventors as: Watt, Murdock, Hornblower, Trevithick, Ericsson, Maudslay and others but all the engines showed some disadvantages that in the end prevented their successful application. Most previously built large rotary steam engines showed extreme sealing problems and failed therefore mainly due to uncontrollable high steam leakages which gave cause to very low volumetric efficiencies. It is therefore one of the primary aims of the instant invention to demonstrate a contact-less gear-type labyrinth seal for this large rotary steam engine with very low steam leakage losses and with a therefrom resulting very high volumetric efficiency. Presently it is not economical to run conventional turbines or any rotary steam engines with steam temperatures much higher than 560° C. due to erosion and corrosion effects such as cavitation or pitting of the rotor blades and other parts. Therefore it is a very important aim of the instant invention to show a large rotary steam engine capable of operating with steam temperatures higher than 560° C. without the necessity of rotor blade cooling and the employment of expensive special steels. It is presently impossible to build large rotary steam engines capable of running with high steam pressures and high revolution due to incomplete internal pressure forces compensation. Therefore, it is an additional aim of the instant invention to show a rotary steam engine with a total internal radial and axial pressure forces compensation. Another important aim of the instant invention is to show a continuous smooth torque power output at the power take-off shaft as necessary for high power energy conversion application. Conventional steam turbines work at their maximum efficiency only at full load and a respective high rate of revolution. Under partial load condition the efficiency of conventional steam turbines deteriorates rapidly. It is therefore a further most important aim to show a rotary steam engine capable of operation at all load conditions with an efficiency equal or even higher than at full load condition. It is furthermore the aim of the instant inventions to show a rotary steam engine capable of operation with extreme wet steam, undegassed steam as well as steam containing large amounts of impurities.

SUMMARY OF THE INVENTION

The objects of the invention are attained by constructing a displacement-type rotary system steam-turbine engine that mainly functions as a displacing-type steam engine that in addition also partially utilizes the kinetic energy generated by the fast flowing steam molecules impinging upon the rotor blades thus functioning also similar to a radial flow turbine. The instant invention comprises an upper half housing and a lower half housing whereby both half's are tightly screwed together with their flange rims. The two-stage turbine without total internal pressure compensation consists preferably of three blades rotor chambers, six grooves rotor chambers and one gear chamber all situated parallel to each other on their respective shaft. Each housing chamber is formed from preferably a set of three aligned and intersecting cylindrical first or second-stage chambers capable to embody one first or second-stage blades rotor and two first or second-stage grooves rotors mounted on the left and right horizontally alongside the said blades rotor. The gear chamber situated at the rear of the housing is up to a certain rotor diameter equipped with gear wheels having the same diameter as the rotors. Rotors of very large diameter and high revolution are preferably equipped with five smaller gear wheels to keep the circumferential velocity of the gear wheels as low as possible. The first-stage, and the two second-stage blades rotors as well as the large gear wheel are all mounted on the same shaft. Each set of grooves rotors and the corresponding small gear wheel are also mounted on a mutual shaft. Each set of blades rotor chambers and the corresponding small gear wheel are also mounted on a mutual shaft. Each set of blades rotor chambers and the respective grooves rotor chambers are sealed from the other sets of chambers and from the gear chamber. On the circumferential surface of the blades rotors and on the surface of the grooves rotors small gear-type teeth are arranged such that a contact-less meshing can be accomplished as said rotors rotate about their respective axis. The large gear wheel and the small gear wheels are precision ground and mesh very exactly thus allowing the synchronization of the rotation of the contact-less meshing rotors. The housing further comprises for each chamber corresponding inlet ports and outlet ports situated diametrical to each other and leading to the respective blades rotor chamber. Mounted longitudinally on the surface of the said blades rotors thick rotor blades are situated spaced radially equidistant from each other. The grooves rotors possess a corresponding number of blade grooves varying in number respective to the number of rotor blades and the ratio of mutual rotor revolution. To obtain a continuous smooth torque moment at the power take-off shaft the said rotor blades mesh with the said blade grooves without surface contact leaving for the steam a gap large enough to prevent the forming of a one sided pressure build-up between the turbine blade under one sided pressure exerted by the pressurized working medium within said chamber and the next turbine blade on the same blades rotor meshing with the corresponding blade groove of the grooves rotor. An internal pressure compensation between two rotor blades as described would result in a periodic torque cancellation thus being perceptible at the power take-off shaft as an uneven power output which would soon prove detrimental by large power conversion application. Parallel between said rotor blades and said blade grooves comparative small gear-type teeth are situated. Said gear-type teeth mesh contact-less but very tightly with the complementary teeth of the opposing rotor thus establishing a very effective dynamic friction-less labyrinth gear-type sealing action between the meshing rotors thereby attaining a high volumetric efficiency. The rotor blades of the said blades rotors and the said small gear-type teeth of the grooves rotors move as they rotate about their corresponding shaft very close to their respective hollow cylindrical interior chamber wall thus performing with their gear-type teeth a dynamic frictionless labyrinth sealing action thereby sealing that part of the cylindrical interior chamber that embodies the working medium under pressure from that part of the cylindrical interior chamber that embodies the working medium under pressure from that part of the cylindrical interior chamber that embodies the working medium in a state of partial expansion. The sealing action subdivides the said cylindrical interior chamber parts into at least two different and sealed from each other pressure states. The space volume displacing action of the pressurized medium within said chamber parts generates a continuous rotational work condition by continuously exerting a pressure upon that side of the rotor blades facing in the direction of rotation as said rotor blades pass tightly through their respective chamber. The object of attaining a high volumetric efficiency is furthermore reached by utilizing the two sets of second stage chambers situated on each side of the set of the first-stage chamber as partial expansive working medium volume chambers. The pressurized working medium introduced through the inlet ports of the first-stage chamber does work by forcing the said rotor blades in a displacing mode through the said first-stage chamber after which it expands into the interconnected two second-stage chambers. The total chamber volume of the said two second-stage chambers is many times that of the former first-stage chamber. Wherefore the ratio of the leakage rate of the pressure reduced working medium per chamber of the working medium is accordingly much lower. The energy inherent in the partially expanded lost working medium is subsequently much lower. Therefore as the total volume of the second-stage chambers increase in relation to the first-stage chamber the energy loss through the leakage of the working medium comparatively decreases. Therefore the effective leakage of the working medium is reduced to a proportional fraction thus consequently resulting in a respective considerable additional increase of volumetric efficiency. The erosion and corrosion within a steam turbine increases among other proportionally with the increase of the temperature of the working medium. Thus the introduction of a rotor cooling means without directly effecting a temperature reduction of the working medium produces an inverse effect on the erosion and corrosion within the turbine. The solution of the problem was achieved by constructing the cylindrical interior chamber wall such that only approximately half of the exterior circumferential blades rotor surface is exposed to the high temperature working medium. The other half of the exterior circumferential blades rotor surface is exposed to the partially expanded and therefore extensively cooler working medium thus subsequently experiencing a respective cooling. The cooling capacity increases approximately linearly with the increase of the surface exposed to the coolant and the temperature difference of the media. The erosion and corrosion effects also rise with the increase of the flow velocity of the working medium. Due to the displacing effect within the instant invention the flow velocity of the working medium exceeds only insignificantly the circumferential velocity of said blades rotors and consequently the erosion and corrosion effect is reduced respectively. Contrary to the thin rotor blades of conventional turbines the rotor blades of the instant invention are designed very thick and short and therefore various types of surface coatings or special materials such as ceramics become applicable thus reducing the erosion and corrosion effects of the rotor blades even further.

A further reduction of erosion and corrosion is accomplished by constructing the blades rotor and the rotor blades hollow and thus perform with the aid of the coolant an internal cooling. The pressure forces compensation of the blades rotor was achieved by arranging an even number of rotor blades on the blades rotor surface and by arranging the inlet ports, the outlet ports within the interior cylindrical chamber diametrical to each other such that the pressure force moments oppose and cancel each other. To cancel the pressure force moments of the grooves rotors completely additional two pressure force compensation rotors are mounted between the first-stage grooves rotors and the second-stage grooves rotors on their respective shaft. The circumferential surface of the two said pressure forces compensation rotors is polished and a surface area equivalent in size times pressure and direction to counter all the opposing pressure force moments is sealed and connected by a tubing to a first-stage inlet port. The pressure force compensation is thus performed automatically for all pressure states. Therefore all axial forces, radial forces and even the forces exerted by the weight of the rotors can be compensated thus it becomes possible to run each pressure stage of this instant invention with a respective high steam pressure and revolution. The instant invention as constructed reduces high pressure steam similar to a one or two stage radial flow tandem build turbine. A speed control regulates the pressure and the volume of the working medium to be utilized for the displacing process. Thus a very useful turbine system with excellent attributes, a very high thermal efficiency and very high overall efficiency is provided. The instant invention can also be used as a combination of a turbine and a pump or compressor.

Further applications of the instant invention are among other: compressors, pumps, motors, etc.

BRIEF DESCRIPTION OF THE DRAWINGS

Other and further object of the instant invention will become more apparent from the following detailed description of the various embodiments thereof when taken with reference to the appended drawings in which like characters refer to like structure and in which.

DETAILED DESCRIPTION OF THE PREFERRED EMBODIMENT

Figure 1:
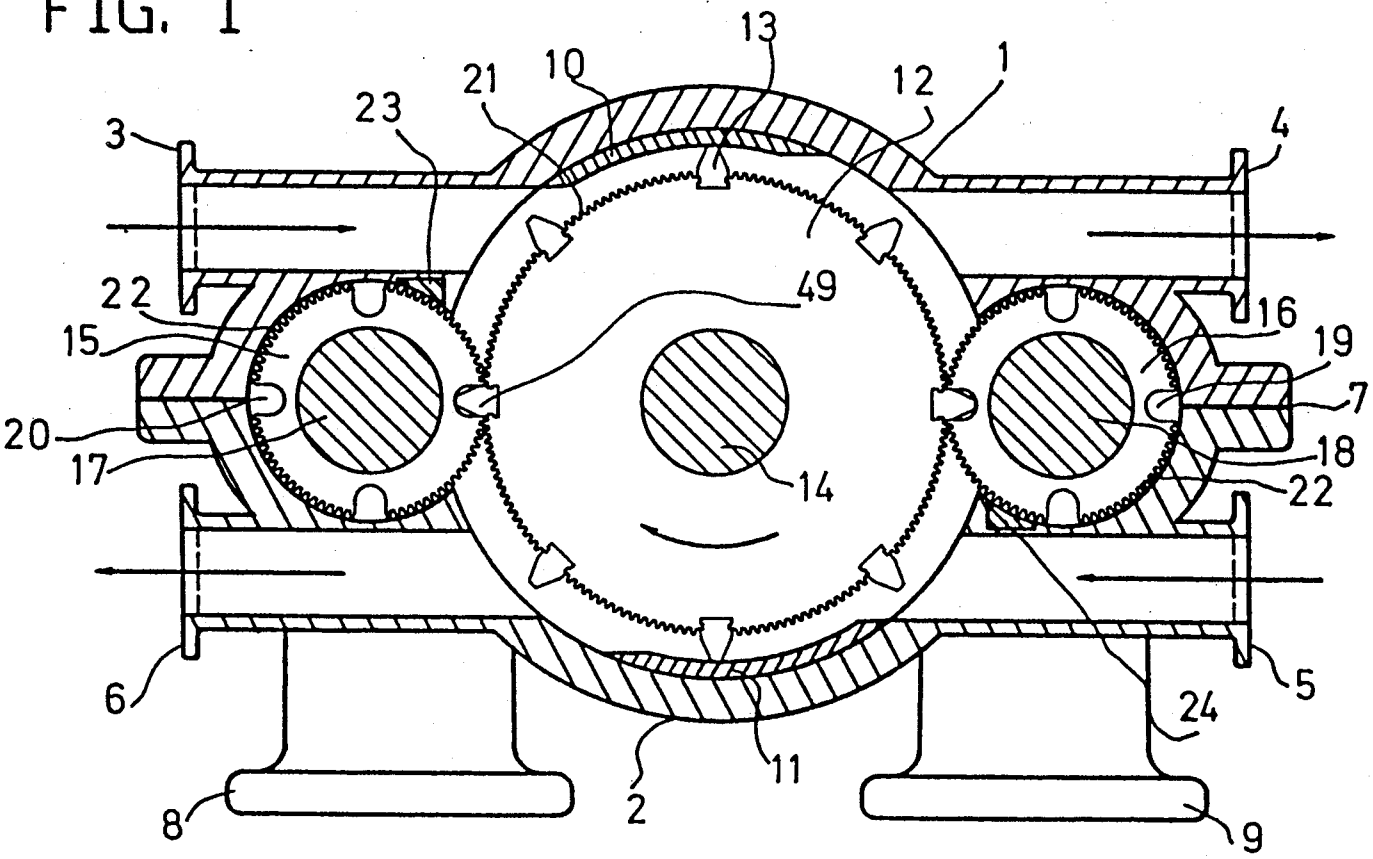
FIG. 1 shows a front view of a vertical center cut about the set of first-stage rotors of the instant invention.
Figure 2:
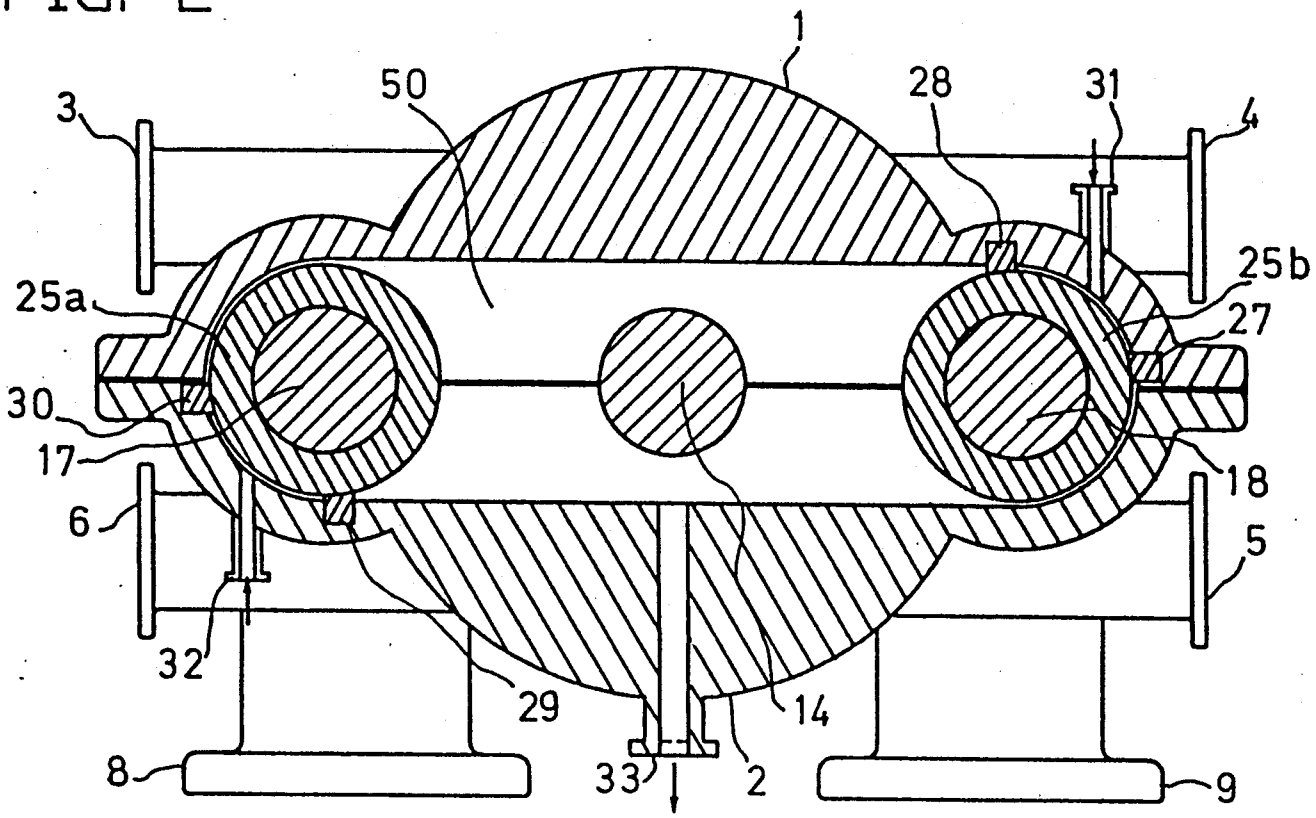
FIG. 2 shows a front view of a vertical center cut about the compression compensating rotors of the instant invention.
Figure 3:
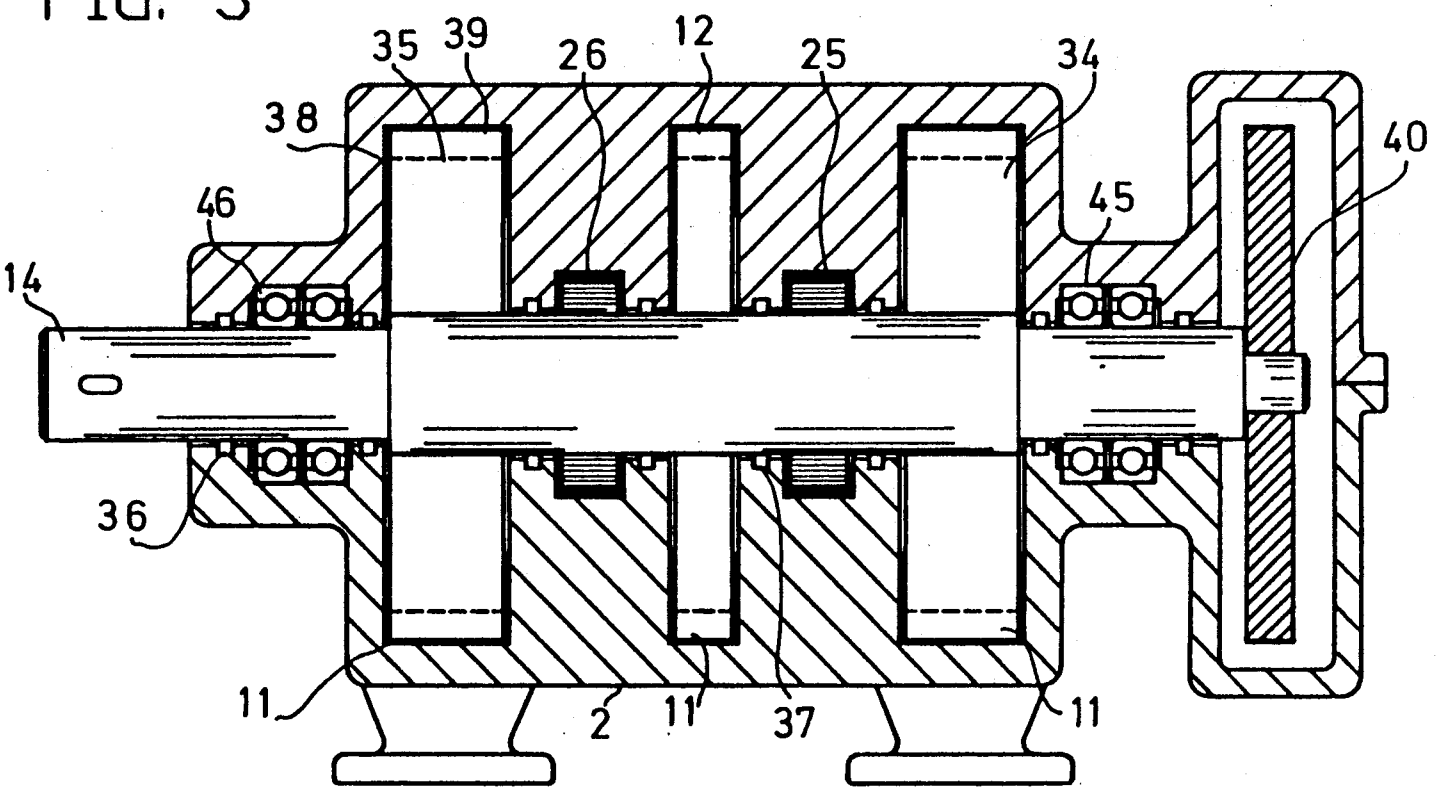
FIG. 3 shows a side view of a vertical cut of the instant invention depicting also the two pressure compensation rotors.
Figure 4B:
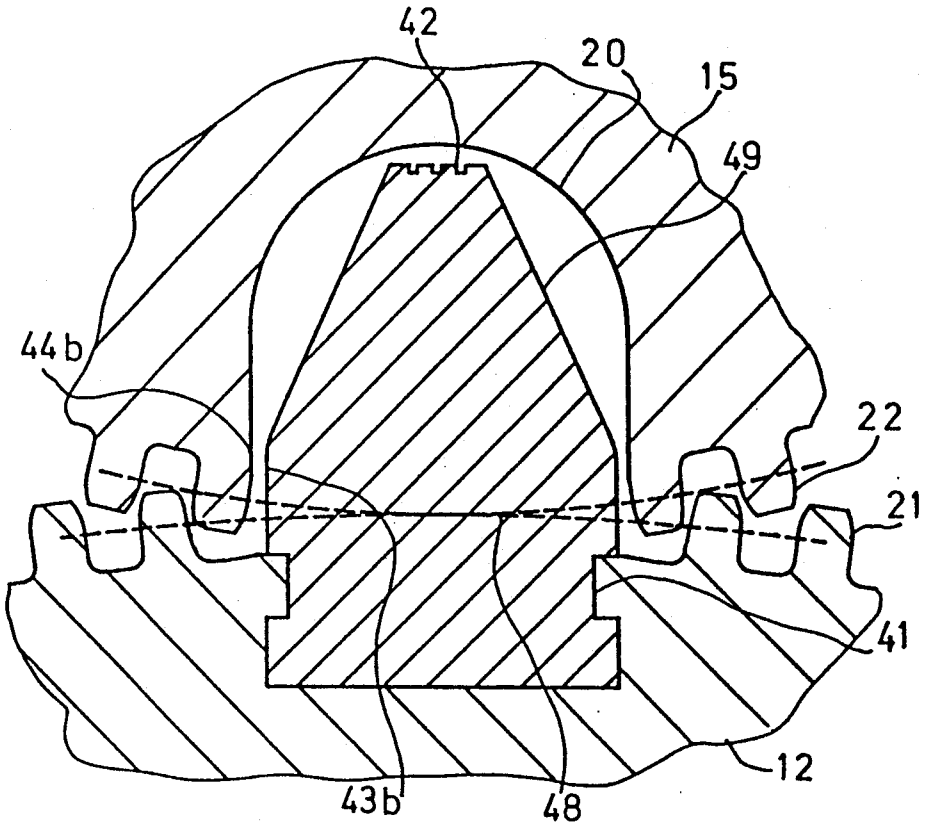
FIGS. 4(*a*) and 4(*b*) show part of an enlargement of a vertical cut through part of the blades-rotor of the instant invention FIG. 4(*b*), with a comparison to a blade-rotor without gear-type teeth FIG. 4(*a*).
Figure 4A:
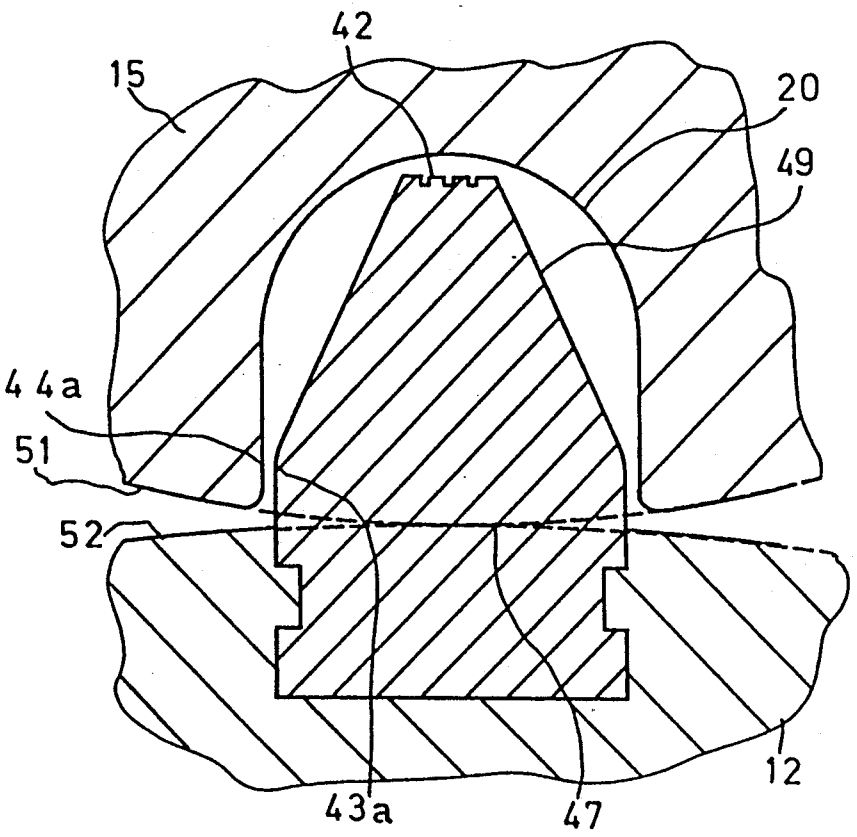

The instant invention as illustrated in FIG. 1 and FIG. 3 comprises an upper half housing 1 and a lower half housing 2. The said housing 1 and 2 embody sets of first and second stage chambers with their respective first and second stage rotors. Centrally situated are a large circular blades rotor chamber and one small circular grooves rotor chamber situated parallel at the left and one at the right side horizontally of the said large blades rotor chamber. Both said housing halves are tightly screwed together with their polished flange rims 7. Both the upper and the lower said housing 1 and 2 embody an inlet port 3 and 5 and an outlet port 4 and 6 whereby the said ports are situated diametrically to each other. To support the housing legs 8 and 9 are rigidly mounted to the lower half housing. Inside the said large circular chamber the first-stage blades rotor 12 is mounted on shaft 14 centrally within the housing. Parallel beside the said first-stage blades rotor 12 the grooves rotors 15 and 16 are mounted on their respective shaft 17 and 18. Mounted longitudinal on the surface of the said blades rotor 12 thick rotor blades 13 are situated spaced radially equidistant from each other. The grooves rotors 15 and 16 possess a corresponding number of blade grooves 19 and 20 varying in number respective to the number of rotor blades 13 and the ratio of the mutual revolution. The rotor blades 13 mesh with the blade grooves 19 and 20 contact-less. The rotor blades 13 move contact-less very close to the adjustable preferably metal insert plates 10 and 11 thus sealing the inlet port 3 and 5 chamber sides from the outlet port 4 and 6 chamber sides wherefore through the introduction of a pressurized medium such as steam through the diametrically opposed inlet ports 3 and 5 a continuous rotational work condition is reached. The seal plates 10 and 11 may be reduced in length so as to extend across only a portion of the radial distance between the inlet ports 3 and 5 and the outlet ports 4 and 6, thus permitting a gradual expansion of the working medium prior to expulsion through the outlet port 4, 6. The said metal rotor chamber seal plates 10 and 11 are preferably to be of such materials that prevent seizure by a possible occurring contact with the rotor blades 13. The side chamber seal plates 38 and 39 are made of such materials that seizure with the rotor blades 13 as well as the blades rotors and the grooves rotors be prevented. It should also be noted that the inside curvature of the housing may be provided with grooves which reach from the grooves rotors 15 and 16 to the adjacent inlet and outlet ports 3, 4, 5 and 6. Parallel between the said rotor blades 13 and the said blade grooves 19 and 20 comparative small gear-type teeth 21 and 22 are situated. The teeth mesh gear-like but contact-less with each other thereby compensating for any differences in rotor diameter which might occur as a result of variations in rotor temperatures. The said gear-type teeth 21 and 22 mesh contact-less but very tightly with the complementary teeth of the opposing rotor thereby establishing a very effective dynamic friction-less labyrinth gear-type sealing action between the said rotors. As illustrated in FIGS. 1 and 4(*b*), the rotor grooves 15 and 16 are designed such that as the rotor blades 13, mesh with the corresponding rotor grooves 19 and 20 (the rotor blade 13 illustrated in FIGS. 1 and 4(*b*) as meshing with the groove 20 is designated rotor blade 49), preferably at least two gear-type teeth 22, one on each side of the groove 20, mesh tightly but without contact with the corresponding gear-type teeth 21 of the blades rotor 12 thus forming a continuous dynamic labyrinth gear-type sealing action between the rotors 12 and 15, and 12 and 16. The gear-type teeth 22 of the grooves rotors 15 and 16 rotate very tightly but contact-less to the seal plates 23 and 24 thus establishing a sealing action between the chamber side close to the inlet ports 3 and 5 and the rotor chamber side close to the outlet ports 6 and 4. The contact-less meshing of all the rotors is accomplished through the synchronization gear wheels 40 shown in FIG. 3. The gear-type teeth 21 and 22 formed on the grooves rotors 15 and 16 and the blades rotor 12 are arranged and formed so as to serve the function of the synchronizing gear in cases of malfunction of the synchronization gear wheels 40. Rotors of very large diameter and high revolutions are preferably equipped with smaller gear wheels 40, with additional gear wheels serving as step-down gear wheels connecting the gear wheels 40 mounted to each of the rotor shafts so as to keep the circumferential velocities as low as possible. To function as a two stage expansion turbine the second-stage blades rotors 34 and 35 are mounted on the mutual central shaft 14 on each side of the said first-stage blades rotor 12 and the corresponding second-stage groove rotors are mounted on shaft 17 and 18. The total volume between two successive rotor blades of the blades rotors 34 and 35 are many times that of the volume of the blades rotor 12 thus permitting a respective second-stage internal steam expansion. It should be understood that to function as a two-stage expansion turbine, the blades rotor 12 operates with a working medium at one pressure while the blades rotors 34 and 35 operate with a working medium at a second, lower pressure. Between the blades rotors 34, 12 and 35 are the pressure compensation rotors 25*a*, 25*b*, and 26*a*, 26*b* are mounted on the shaft 17 and 18 respectively. FIG. 2 shows the pressure compensation rotors 25*a* and 25*b* mounted on their respective shaft 17 and 18. The labyrinth seals 27, 28, 29 and 30 seal contact-less part of the polished surface of the pressure compensating rotors 25*a* and 25*b* from the chamber 50. The inlet ports 3 and 5 are interconnected with the inlet ports 31 and 32 thus automatically producing an equal pressure exertion diametrically on the surfaces of the pressure compensating rotors 25*a*, 25*b* and 26*a*, 26*b* and the grooves rotors 15 and 16 whereby a total pressure compensation is attained. Contrary to the grooves rotors the blades rotors 12, 34 and 35 are always fully pressure compensated due to the fact that the steam pressure forces always occur diametrically wherefore the counter directed forces cancel each other. The outlet ports 4 and 6 of the chamber of the blades rotor 12 and outlet port 33 of the pressure compensating rotors are interconnected, with the inlet ports of the chamber of the blades rotors 34 and 35 thus transforming leakage steam into additional working medium thereby improving the volumetric efficiency of the instant invention.

FIG. 4(*a*) depicts the two contact-less revolving rotor surfaces 51 and 52 without the gear-type teeth 21 and 22 have although with equal pitch circles 47 and 48 extreme large steam leakages through the gap 43*a* and 44*a* about the contact-less meshing rotor blade 49 and the corresponding rotor groove 20. FIG. 4(*b*) depicts the gap 43*b* and 44*b* shows with equal pitch circles 47 and 48 a far lesser steam leakage due to the sealing ability of the contact-less meshing gear-type teeth 21 and 22 thus producing a considerable increase in the volumetric efficiency. The gap 43 and 44 prevents a steam pressure build-up as shown between the rotor blades 13 and 49 whereby otherwise an internal pressure compensation between said rotor blades would occur thus resulting in a periodic torque cancellation thus being perceptible as an uneven power output at the power take-off shaft. The rotor blades are mounted within t-grooves 41 and possess at their tip grooves 42 to enhance their labyrinth sealing ability. At the sides of all rotors seizure preventive seal plates 38 and 39 are installed. Due to the pressure compensation of the rotors only minimal forces act on the rotor shafts 14, 17 and 18 thus permitting among other the application of fast turning ball bearings 45 and 46. The seal 36 and 37 seal between all respective chambers.

The instant invention is used as a combination of turbine and pump or compressor by using the two blades rotors 34 and 35 to compress a medium such as air by using the inlet ports as outlet ports and the outlet ports as inlet ports for that medium and by furthermore using the blades rotor 12 to do work in a displacing fashion as described.

It will be manifestly appreciated by those skilled in the art that the instant invention can be employed in various form such as compressor, pump, motor, etc.. It should be understood therefore that the various embodiments herewith described and disclosed have only been shown by way of example and other and further modifications of the instant invention may be made without avoiding the spirit or scope thereof. The embodiment of the instant invention in which an exclusive property or privilege is claimed is defined as follows:

I claim:

1. A displacement type rotary turbine comprising:

a housing having means defining at least one hollow inner space divided into a plurality of aligned and partially intersecting cylindrical chambers, said plurality of cylindrical chambers together comprising one chamber set;

a like plurality of adjacent shafts rotably connected to said housing, each of said plurality of shafts extending parallel with one another and positioned substantially at the center of one of said plurality of chambers, respectively; said housing further including means defining at least two inlet and at least two outlet channels for entry and exit, respectively, of a working medium to said chamber set, said inlet and outlet channel means being arranged on said housing such that the respective inlet channels and the respective outlet channels are diametrically opposed from each other to permit the pressure force moments created by passage of working medium therethrough to oppose and cancel each other, said inlet and outlet channels are further arranged in parallel such that inlet channels face outlet channels thus providing a high velocity steam passage;

said chamber set having a first rotor mounted on a centermost one of said plurality of shafts, said first rotor including an outer surface having a plurality of pressure blades mounted so as to extend longitudinally thereon and at radially spaced apart positions, said first rotor outer surface further including gear-type teeth formed thereon;

said chamber set further including a plurality of groove rotors mounted on the shafts adjacent said centermost shaft, each of said groove rotors being disposed in close proximity to said first rotor and having an outer surface including a plurality of grooves spaced radially thereon in a manner corresponding to the spacing of said pressure blades, each of said groove rotors outer surfaces further including gear-type teeth formed thereon, each groove formed in said outer surface is shaped to receive one of said plurality of pressure blades to permit the meshing of said pressure blades with said grooves during rotation of said first rotor and said groove rotor;

said first rotor gear-type teeth mesh tightly, but contact-less, with the gear-type teeth of each of the groove rotors whereby a continuous dynamic frictionless labyrinth seal between said first rotor outer surface and the outer surface of each of said plurality of groove rotors is established;

said pressure blades mesh with said grooves in a contact-less manner throughout the meshing sequence so as to define a continuing gap therebetween and said groove and first rotor gear-type teeth also mesh such that at least two gear-type teeth, one on each side of the groove of said grooves rotor, mesh tightly but without contact with the corresponding gear-type teeth of the blades rotor whereby a substantially constant torque is provided on the centermost shaft;

means for establishing a pressure seal between said housing and said chamber set so as to isolate the working medium;

a chamber seal plate for each inlet means, said seal plate being mounted to said housing and disposed in said chamber set so as to be in close proximity to said first rotor and so that said pressure blades move relatively to each said seal plate so that a dynamic frictionless seal is created thereby isolating the chamber part containing the working medium in a state of expansion from the chamber part containing the pressurized working medium;

means for synchronizing the rotation of the respective shafts; and power take-off means operatively associated with said first rotor for connecting said turbine to a utility device.

2. A displacement type rotary turbine as in claim 1, wherein at all times at least two of said first rotor gear-type teeth mesh with a like number of said groove rotor gear-type teeth in establishing the continuous dynamic labyrinth seal.

3. A displacement type rotary turbine as in claim 1, wherein said synchronizing means comprises a plurality of gear wheels with one mounted to the end of each of said plurality of shafts with said plurality of gear wheels being drivingly connected to one another.

4. A displacement type rotary turbine as in claim 1, wherein an even number of pressure blades are mounted on said first rotor.

5. A displacement type rotary turbine as in claim 1, wherein the tip of said pressure blades are provided with a plurality of lengthwise extending grooves so that the seal established between said pressure blades and the chamber seal plates is enhanced.

6. A displacement type rotary turbine as in claim 1, wherein the first rotor gear-type teeth and the groove rotor gear type teeth are arranged and formed so as to serve as the synchronizing gear for a period of time during which said synchronizing means is malfunctioning.

7. A displacement type rotary turbine as in claim 1, wherein said housing further includes means defining at least one groove disposed in the portion of said housing with a curvature in close proximity to said plurality of pressure blades thereby defining a gap between said housing curvature and said pressure blades, said groove in housing curvature disposed such that said groove reaches from the groove rotor to the inlet port adjacent thereto and from the outlet port to the groove rotor adjacent thereto.

8. A displacement type rotary turbine as in claim 1, wherein said pressure blades are mounted with a T-groove in said first rotor so as to facilitate ease of replacement of said pressure blades.

9. A displacement type rotary turbine as in claim 1 wherein said gear-type teeth formed on said outer surfaces of both said first rotor and said plurality of groove rotors mesh contact-less to compensate for any differences in rotor diameter which might occur as a result of variations in rotor temperatures.

10. A displacement type rotary turbine as in claim 1, wherein each of the chamber seal plates extend across only a portion of the radial distance between said inlet and outlet channel means such that working medium gradually expands prior to entering said outlet channel means.

11. A displacement type rotary turbine as in claim 1, wherein said means for establishing a pressure seal between the housing and the chamber set comprises a circular pressure ring disposed between said housing and said plurality of shafts on both sides of said chamber set, two circular side chamber seal platers mounted to said housing and being disposed on the inside walls of said chamber set so as to be in close proximity to said first rotor, and a groove rotor seal plate mounted to said housing so as to be in close proximity to each of said plurality of groove rotors.

12. A displacement type rotary turbine as in claim 11, wherein the circular side chamber seal plates of the groove rotors have a sealing surface of at least twice the width of said rotor grooves.

13. A displacement type rotary turbine as in claim 11, wherein all of the seal plates are comprised of a material other than the material of said first and grooves rotors and of said pressure blades.

14. A displacement type rotary turbine as in claim 11, wherein all of the seal plates are comprised of materials which minimize the possibility of a seizure caused by contact with said first and groove rotors.

15. A displacement type rotary turbine as in claim 11, wherein said groove rotor seal plate is disposed on said housing adjacent said inlet means.

16. A displacement type rotary turbine as in claim 1, wherein said housing further includes means defining a plurality of additional chamber sets through which said plurality of shafts extend, said additional chamber sets being spaced apart from one another axially within said housing, said housing further including a means defining additional inlet and two outlet channel means for allowing entry and exit of a working medium to each of said additional chamber sets, said additional inlet and outlet channel means being arranged on said housing at diametrically opposed positions so as to permit the pressure force moments created by passage at working medium therethrough to oppose and cancel each other.

17. A displacement type rotary turbine as in claim 16, wherein said first rotor in one of said chamber sets functions in the displacing fashion while said first rotor in another chamber set functions by pumping or compressing a medium thereby providing pressure force compensation.

18. A displacement type rotary turbine as in claim 16, wherein said housing further includes means defining at least one pressure compensating chamber formed from a plurality of aligned partially intersecting cylindrical chambers, said pressure compensation chamber disposed axially along said plurality of shafts and being positioned between and spaced from each of two said chamber sets, said pressure compensation chamber having one pressure compensating rotor mounted on each of said plurality of shafts having groove rotors mounted thereon, said housing further including means defining at least one inlet for each pressure compensating rotor and at least one outlet for each pressure compensation chamber for entry and exit, respectively, of a working medium to each of said pressure compensation chambers, and a means for establishing a labyrinth pressure seal so as to isolate the working medium within the pressure compensating chambers.

19. A displacement type rotary turbine as in claim 18, wherein said labyrinth pressure seal means comprises two curved compensating rotor seal plates mounted on said housing in close proximity to said compensating rotors.

20. A displacement type rotary turbine as in claim 18, wherein said first rotor in one of said chamber sets is adapted for working with a first working medium, while said first rotor in another of said chamber sets is adapted for working with a second working medium having a lower pressure than the first working medium.

21. A displacement type rotary turbine as in claim 20, wherein the outlet channels of the chamber set provided with said first rotor designed to operate with the first working medium commutes with the outlet channel for the pressure compensating chamber and are further connected to the inlet channels for the chamber sets designed to operate with the second working medium.

22. A displacement type rotary turbine comprising:

a housing having means defining at least one hollow inner space divided into as plurality of aligned and partially intersecting cylindrical chambers, said plurality of cylindrical chambers together comprising one chamber set;

a like plurality of adjacent shafts rotably connected to said housing, each of said plurality of shafts extending parallel with one another and positioned substantially at the center of one of said plurality of chambers, respectively; said housing further including means defining inlet and outlet channels for entry and exit, respectively, of a working medium to said chamber set, said inlet and outlet channel means being arranged on said housing such that inlet channel to inlet channel and outlet channel to outlet channel are diametrically opposed to permit the pressure force moments created by passage of working medium therethrough to opposite and cancel each other, said inlet and outlet channels are further arranged in parallel such that inlet channels face outlet channels thus providing a high velocity steam passage;

said chamber set having a first rotor mounted on a centermost one of said plurality of shafts, said first rotor including an outer surface having a plurality of pressure blades mounted so as to extend longitudinally thereon and at radially spaced apart positions, said first rotor outer surface further including gear-type teeth formed thereon;

said chamber set further including a plurality of groove rotors mounted on the shafts adjacent said centermost shaft, each of said groove rotors being disposed in close proximity to said first rotor and having an outer surface including a plurality of grooves spaced radially thereon in a manner corresponding to the spacing of said pressure blades, each of said groove rotors outer surfaces further including gear-type teeth formed thereon, each groove formed in said outer surface is shaped to receive one of said plurality of pressure blades to permit the meshing of said pressure blades with said grooves during rotation of said first rotor and said groove rotor;

said first rotor gear-type teeth mesh tightly, but contact-less, with the gear-type teeth of each of the groove rotors whereby a continuous dynamic frictionless labyrinth seal between said first rotor outer surface and the outer surface of each of said plurality of groove rotors is established;

said pressure blades mesh with said grooves in a contact-less manner throughout the meshing sequence so as to define a continuing gap therebetween and said groove and first rotor gear-type teeth also mesh such that at least two gear-type teeth, one on each side of the groove of said grooves rotor, mesh tightly but without contact with the corresponding gear-type teeth of the blades rotor whereby a substantially constant torque is provided on the centermost shaft;

means for establishing a pressure seal between said housing and said chamber set so as to isolate the working medium;

a chamber seal plate for each inlet means said seal plate being mounted to said housing and disposed in said chamber set so as to be in close proximity to said first rotor and so that said pressure blades move relatively to each said seal plate so that a dynamic frictionless seal is created thereby isolating the chamber part containing the working medium in a state of expansion from the chamber part containing the pressurized working medium;

said housing further includes means defining a plurality of additional chamber sets through which said plurality of shafts extend, said additional chamber sets being spaced apart from one another axially within said housing, said housing further including a means defining additional inlet and outlet channel means for allowing entry and exit of a working medium to each of said additional chamber sets, said additional inlet and outlet channel means being arranged on said housing at diametrically opposed positions so as to permit the pressure force moments created by passage at working medium therethrough to oppose and cancel each other;

said housing further includes means defining at least one pressure compensating chamber formed from a plurality of aligned partially interacting cylindrical chambers, said pressure compensation chamber disposed axially along said plurality of shafts and being positioned between and spaced from each of two said chamber sets, said pressure compensation chamber having one pressure compensating rotor mounted on each of said plurality of shafts having groove rotors mounted thereon, said housing further including means defining at least one inlet for each pressure compensating rotor and at least one outlet for each pressure compensation chamber for entry and exit, respectively, of a working medium to each of said pressure compensation chambers, and a means for establishing a labyrinth pressure seal so as to isolate the working medium within the pressure compensating chambers means for synchronizing the rotation of the respective shafts; and power take-off means operatively associated with said first rotor for connecting said turbine to a utility device.

23. A displacement type rotary turbine as in claim 22, wherein said compensating pressure seal means comprises two curved compensating rotor seal plates mounted on said housing in close proximity to said compensating rotors.

24. A displacement type rotary turbine as in claim 22, wherein said first rotor in one of said chamber sets is adapted for working with a first working medium, while said first rotor in another of said chamber sets is adapted for working with a second working medium having a lower pressure than the first working medium.

25. A displacement type rotary turbine as in claim 24, wherein the outlet channels of the chamber set provided with said first rotor designed to operate with the first working medium commutes with the outlet channel for the pressure compensating chamber and are further connected to the inlet channels for the chamber sets designed to operate with the second working medium.

26. A displacement type rotary turbine comprising:

a housing having means defining at least one hollow inner space divided into a plurality of aligned and partially intersecting cylindrical chambers, said plurality of cylindrical chambers together comprising one chamber set;

a like plurality of adjacent shafts rotably connected to said housing, each of said plurality of shafts extending parallel with one another and positioned substantially at the center of one of said plurality of chambers, respectively; said housing further including means defining inlet and outlet channels for entry and exit, respectively, of a working medium to said chamber set, said inlet and outlet channel means being arranged on said housing at diametrically opposed positions so as to permit the pressure force moments created by passage of working medium therethrough to oppose and cancel each other;

said chamber set having a first rotor mounted on a centermost one of said plurality of shafts, said first rotor including an outer surface having a plurality of pressure blades mounted so as to extend longitudinally thereon and at radially spaced apart positions;

said chamber set further including a plurality of groove rotors mounted on the shafts adjacent said centermost shaft, each of said groove rotors being disposed in close proximity of said first rotor and having an outer surface including a plurality of grooves spaced radially thereon in a manner corresponding to the spacing of said pressure blades, each groove being shaped to receive one of said plurality of pressure blades to permit the meshing of said pressure blades with said grooves during rotation of said first rotor and said groove rotor thereby producing a substantially constant torque output on the centermost shaft;

means for establishing a continuous dynamic frictionless labyrinth seal between said first rotor outer surface and the outer surface of each of said plurality of groove rotors;

means for establishing a pressure seal between said housing and said chamber set so as to isolate the working medium;

a chamber seal plate for each inlet means said seal plate being mounted to said housing and disposed in said chamber set so as to be in close proximity to said first rotor and so that said pressure blades move relatively to each said seal plate so that a dynamic frictionless seal is created thereby isolating the chamber part containing the working medium in a state of expansion from the chamber part containing the pressurized working medium;

means for synchronizing the rotation of the respective shafts;

power take-off means operatively associated with said first rotor for connecting said turbine to a utility device;

said housing further includes means defining a plurality of additional chamber sets through which said plurality of shafts extend, said additional chamber sets being spaced apart from one another axially within said housing, said housing further including a means defining additional inlet and outlet channel means for allowing entry and exit of a working medium to each of said additional chamber sets, said additional inlet and outlet channel means being arranged on said housing at diametrically opposed positions so as to permit the pressure force moments created by passage at working medium therethrough to oppose and cancel each other; and said housing further includes means defining at least one pressure compensating chamber formed from a plurality of aligned partially intersecting cylindrical chambers, said pressure compensation chamber disposed axially along said plurality of shafts and being positioned between and spaced from each of two said chamber sets, said pressure compensation chamber having one pressure compensating rotor mounted on each of said plurality of shafts having groove rotors mounted thereon, said housing further including means defining at least one inlet for each pressure compensating rotor and at least one outlet for each pressure compensation chamber for entry and exit, respectively, of a working medium to each of said pressure compensation chambers, and a means for establishing a compensating rotor pressure seal so as to isolate the working medium within the pressure compensating chambers.

* * * * *